United States Patent [19]

Farney

[11] 4,087,718

[45] May 2, 1978

[54] HIGH GAIN CROSSED FIELD AMPLIFIER

[75] Inventor: George K. Farney, Boxford, Mass.

[73] Assignee: Varian Associates, Inc., Palo Alto, Calif.

[21] Appl. No.: 683,990

[22] Filed: May 6, 1976

[51] Int. Cl.[2] ..... H01J 25/34

[52] U.S. Cl. ..... 315/39.3; 315/3.5; 315/3.6

[58] Field of Search ..... 315/3.6, 39.3, 3.5

[56] References Cited

U.S. PATENT DOCUMENTS

| | | | |
|---|---|---|---|
| 2,687,777 | 8/1954 | Warnecke et al. | 315/3.6 X |
| 2,794,146 | 5/1957 | Warnecke et al. | 315/3.6 X |
| 2,807,744 | 9/1957 | Lerbs | 315/3.6 |
| 3,046,443 | 7/1962 | Dench | 315/3.6 X |
| 3,069,587 | 12/1962 | Dench | 315/3.5 |
| 3,384,782 | 5/1968 | Reddish | 315/3.6 X |
| 3,631,315 | 12/1971 | Osepchuk | 315/3.5 |

*Primary Examiner*—Saxfield Chatmon, Jr.
*Attorney, Agent, or Firm*—Stanley Z. Cole; Peter J. Sgarbossa

[57] ABSTRACT

The allowable gain of a crossed-field amplifier tube is increased by tapering the slow-wave interaction circuit to a smaller spatial period in the direction of circuit power flow. Concurrent variation of the electron beam drift velocity by tapering the dc electric or magnetic field further improves the gain and efficiency.

6 Claims, 9 Drawing Figures

HIGH GAIN CROSSED FIELD AMPLIFIER

FIELD OF THE INVENTION

The invention relates to electron tubes in which a microwave signal is amplified by interaction of the electromagnetic field of a slow-wave circuit carrying the signal with a stream of electrons flowing between the circuit and a continuous cathode electrode. The electrons are guided by a dc electric field between the circuit and cathode and a magnetic field perpendicular to the electric field and parallel to the cathode surface. They drift in a direction generally parallel to the length of the circuit at a velocity approximately equal to that of the wave on the circuit. In such tubes the efficiency is increased by recirculating the electron stream past the circuit.

The gain which the tubes can have is limited by instabilities of the space-charge spokes in the small-signal end of the tube.

PRIOR ART

Traveling-wave amplifier tubes of the linear-beam type have had the circuit wave velocity slowed down to a lower value near the tube's output so that the wave will stay in synchronism with the electron beam as the beam transfers kinetic energy to the circuit wave energy and slows down. The action of tapered circuits is discussed in the book "Power Travelling-Wave Tubes" by J. F. Gittins, American Elsevier, 1965, pages 35–37. The tapering is restricted to a short section near the output where the circuit wave is quite large.

Amplifiers of the crossed-field category behave quite differently. The drift velocity of the electrons is relatively constant as they lose energy since it is potential rather than kinetic energy they transfer to the circuit. Therefore, velocity tapering as in linear-beam TWT's is not applicable.

It is known that stability of a crossed-field electron tube is dependent on a "spoke stability factor" S. This factor is described in Section 5.2.6 of the book "Crossed-Field Microwave Devices" edited by E. Okress, Academic Press, New York, 1961, and is defined as $$S = g/h$$

where $g = (v_e - v_p)/v_p$ is the percentage excess of the electron drift velocity $v_e$ over the phase velocity $v_p$ of the wave on the slow-wave circuit (as is well known $v_e$ is proportional to the ratio of electric to magnetic fields) and $$h = E_{rf}/E_o$$

is the ratio of radio frequency electric field $E_{rf}$ at the electron hub surface to the electric field $E_o$ which will cause the electrons to drift in exact synchronism with the wave (corresponding to the "Hartree" voltage between anode and cathode).

Smaller values of the stability factor S correspond to more stable operation, permitting higher gain. On the other hand, efficiency and output power are increased by increasing $g$, with attendant decrease of stability.

U.S. Pat. No. 3,069,594 issued Dec. 18, 1962 to J. Feinstein describes some methods to improve the gain without sacrificing stability by gradually changing the interaction characteristics along the circuit. One method involves changing the parameters of the periodic circuit elements to vary the phase shift per element from a smaller value at the input end to a larger value at the output end. This provides an advantageous synchronous condition (small $g$) at the small-signal end of the circuit where the radio frequency field E is low. However, such slow-wave circuits with varying phase shift per section have proven to be very difficult to match to input and output transmission lines over a broad frequency band, thus promoting other kinds of instabilities. Inspection of Feinstein's FIG. 2 reveals that the frequency range over which the desirable phase shift can be used is considerably less than the useful bandwidth of a circuit composed of uniform elements (represented by any one of his $\omega$-$\beta$ curves).

Feinstein also discloses tapering the spacing between cathode and anode, by placing a cylindrical cathode off-center or by a spiral section cathode. By decreasing the spacing near the output end, the dc electric field is increased, hence the electron drift velocity $v_e$ and hence $g$.

Unfortunately, the tapered spacing has an inherent fault. The proportion of rf electric field reaching the cathode $E_{rf}$ decreases rapidly (exponentially) with increase of the circuit-to-cathode spacing. Thus the stability factor in the small signal region is worsened by the tapered spacing, and a compromise between the two effects must be adopted.

Other prior art included attempts to taper the drift velocity by a non-uniform magnetic field. This method involved further compromises between gain and efficiency.

SUMMARY OF THE INVENTION

An objective of the invention is to provide a crossed-field amplifier tube with improved stability, gain and efficiency.

A further objective is to provide a tapered slow-wave circuit which can be well matched to transmission lines over a broad frequency band.

A further objective is to provide a tapered slow-wave circuit which can be easily designed and constructed.

A further objective is to provide a tube in which both the slow-wave circuit and the electron drift velocity are tapered to provide optimum spoke stability and efficiency.

The above objectives are realized by varying the spatial period length of the circuit elements, keeping other characteristics relatively constant along the circuit. Thus the wavelength of a signal wave on the circuit is tapered. The tapering extends over a greater part of the length of the circuit. Circuits well adapted for this treatment are those in which the signal flows at constant velocity along a path which is largely transverse to the general extent of the circuit past which the electron stream flows. Examples are the helix, the interdigital line and the meander line. These circuits generally have large band-widths.

Control of the circuit pitch by the inventive circuits can by over a sufficient range that the cathode-to-anode spacing may be tapered in the direction opposite to prior-art teachings, i.e., from closer at the input to farther at the output, thus preserving optimum spoke stability while at the same time providing the optimum ratio of electron to circuit wave velocity.

Alternatively, the magnetic field may change over the circuit length to control the electron drift velocity. The magnetic field increases from input to output which is opposite to prior art. The magnetic field would increase approximately linearly along the interaction path.

The impedance and bandwidth of the tapered-period circuits are relatively constant, so better matches are obtained to the transmission lines than in prior-art circuits with tapered phase-shift per section.

DESCRIPTION OF THE PREFERRED EMBODIMENTS

Figure 1:
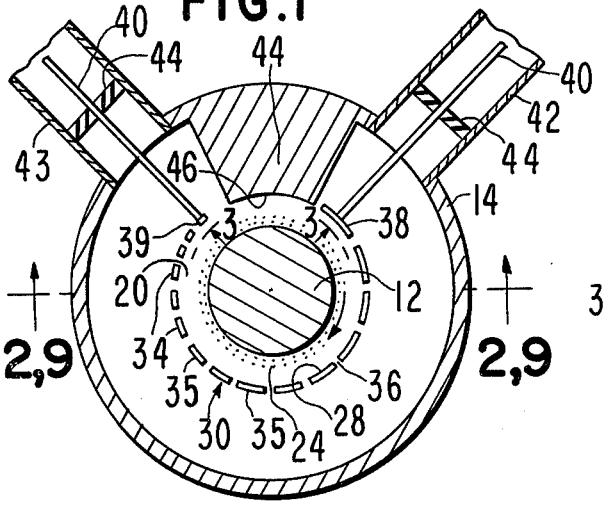
FIG. 1 is a schematic cross section, perpendicular to the axis, of a tube embodying the invention.

An understanding of the preferred embodiments will be facilitated by a review of the physical principles involved. In crossed-field tubes having a continuous cathode along the length of the delay line, the electron stream has a region of fairly continuous flow adjacent the cathode. In tubes of circular section this part of the stream is called the "hub". On the anode side of this layer are "spokes" of space charge projecting toward the anode. The spokes move in synchronism with the electromagnetic wave on the slow wave circuit (the anode) and there is one spoke per wavelength. In an amplifier tube, each spoke grows longer toward the anode as the *rf* field of the circuit becomes larger from the input to the output. Eventually the spoke reaches clear to the anode and its outer electrons are intercepted, to be replaced by others flowing outward through the spoke. There is thus an outward flow from cathode to anode through each spoke.

The spokes are formed and held together by the *rf* electric field of the anode circuit. In turn they induce *rf* current in the circuit so that the circuit wave grows.

There are also forces tending to disperse the space charge in the spokes. The most important are space-charge repulsion and the dragging effect when the unmodulated electron drift velocity differs from the circuit wave velocity. The balance between the dragging dispersive force and the focussing force of the *rf* electric field is described by the "spoke stability factor" S described above. The stability is poorest in the small-signal, input end of the tube. Here the spokes are short and close to the cathode where the *rf* field is the smallest fraction of its peak value at the circuit. The peak amplitude of the wave on the circuit is of course also smallest at the input.

To best explain the structural features of embodiments of the invention, the spoke stability factor will be expressed in terms of physical dimensions of the circuit and the interaction space.

For circuits of the type described above, the phase velocity of a wave along the circuit length is $$v_p = cp/L$$

where $c$ is the wave velocity along the serpentine length, typically a constant close to the velocity of light, $p$ is the periodic length of pitch in the direction of the electron stream, and $L$ is the serpentine length of a period, approximately twice the width of the circuit transverse to its extent along the electron stream. The drift velocity of electrons in crossed fields is:

$$v_e = AE_{dc}/B$$

where $E_{dc}$ is the dc electric field. B is the magnetic field and A is a universal constant. To a close approximation $$E_{dc} = V/d$$

where $V$ is the cathode-to-anode voltage and $d$ is the cathode-to-anode spacing. Thus $v_e = AV/Bd$ The excess drift velocity ratio $g$ is then $$g = \frac{v_e}{v_p} - 1 = \frac{AVL}{BCpd} - 1$$

The *rf* fields of a slow-wave circuit fall off with distance from the circuit at a rate which in a short distance becomes approximately exponential.

$$E = E_\alpha e^{-2\pi X/\lambda}$$

where $x$ is the distance from the circuit, $\lambda$ is the phase wavelength on the circuit and $E_{60}$ represents the equivalent maximum *rf* field right at the circuit itself. For circuits of the type described above, the wavelength $\lambda$ along the circuit is $$\lambda = v_p/f = cp/Lf$$

where $f$ is the frequency of the wave energy. Thus the *rf* field near the cathode surface is approximately $$E_{rf} = E_\alpha e^{-2\pi d/\lambda} = E_\alpha e^{-2\pi dLf/cp}$$

The synchronous electric field $E_o$ is by definition that field for which $v_e = v_p$, that is $$AE_o/B = cp/L$$

or $$E_o = Bcp/LA$$

then $$h = \frac{E_{rf}}{E_c} = \frac{LAE_\alpha}{Bcp} e^{\frac{-2\pi Lfd}{cp}}$$

Thus $$S = \frac{g}{h} = \left(\frac{ALV}{Bcdp} - 1\right) \frac{Bcp}{LAE_\alpha} e^{\frac{2\pi Lfd}{cp}}$$

$$S = \left(\frac{V}{d} - \frac{Bc}{LA} p\right) \frac{1}{E_\alpha} e^{\frac{Kd}{p}}$$

where $K = 2\pi Lf/c$ is a constant To get high stability (small S) one should thus make $$\frac{v_e}{v_p} \simeq 1 \text{ or } \frac{V}{d} \simeq \frac{Bc}{LA} p$$

(wave velocity equal to electron drift velocity) and $d/p$ as small as practical. However, to generate high power and efficiency, it is necessary to have the electron velocity 10 to 20% larger than the wave velocity, at least near the output end. Also, $d/p$ has an optimum value for high output. Thus if one has a uniform delay line uniformly spaced from the cathode the choice of $d$ and $p$ for optimum output is at the expense of degrading the spoke stability at the input end. Spoke stability at the output end is usually no problem because $E_\alpha$ is large there.

According to the invention the circuit wave velocity $v_p$ has a larger value, substantially equal to $v_e$, at the input end, whereby both $g$ and $h$ are small and spoke stability is made good in the region where E is small. Toward the output end of the circuit the wavelength is decreased to get the desired overvoltage but the stability can be maintained by the high value of $E_\alpha$ at the output.

It should be pointed out that in a crossed-field amplifier the wave does not grow exponentially as in a linear-beam TWT, but at a more nearly constant rate. The portion of the circuit which should be tapered according to the invention extends over a greater part of the circuit length or may even cover the entire length. If the short tapered section at the output of a TWT were applied to a crossed-field amplifier, it would not produce the desirable combination of high stable gain and efficiency of the present invention.

The above equation for stability factor in terms of the dimensions of the tube shows how the dimensions may be varied along the circuit to achieve the desired interaction. The first term in the expression for S, proportional to $g$ and thus a measure of the overvoltage, is increased toward the output by decreasing either the cathode-anode spacing $d$ or the circuit pitch $p$. The last term $e^{Kd/p}$ may be decreased toward the output to help maintain stability there, but as described above this may not be needed because $E_\alpha$ becomes large. On the other hand, $d/p$ may be made small at the input where stability is a problem and increased toward the output to its optimum value for power. This implies that $p$ should decrease faster percentagewise than $d$ increases to keep the first term increasing.

When applying the principles of the invention to a slow-wave circuit which is significantly dispersive, such as a chain of coupled cavities, the above equations become inaccurate. However, a similar expression for the spoke stability factor may be written using as a variable, instead of the periodic pitch $p$, the wave length on the circuit which may be measured as a function of frequency.

Figure 3:
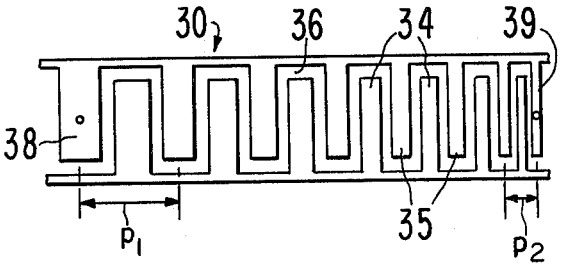
FIG. 3 is an unwrapped view of the interdigital slow-wave circuit of FIG. 1.
Figure 2:
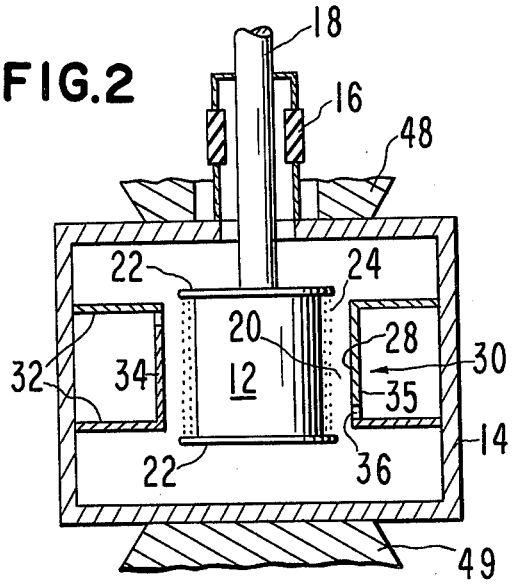
FIG. 2 is an axial section of the tube of FIG. 1, as indicated by line 2—2.

Returning now to the drawings, FIGS. 1, 2 and 3 illustrate a crossed-field amplifier tube embodying the present invention in connection with an interdigital slow-wave circuit. FIG. 1 is a schematic section through the tube perpendicular to its axis. FIG. 2 is a section through the axis of the tube of FIG. 1 and FIG. 3 is an unwrapped view of a portion of the slow-wave circuit as seen from the axis. At the center of the tube is a cylindrical cathode 12 supported from the vacuum envelope 14 via an insulating seal 16 as of alumina ceramic, and a metallic support post 18 as of molybdenum. In high-power tubes the cathode may be of solid metal, the electron stream being generated by secondary emission. Alternatively, it may be a thermionic emitter heated by an internal radiant heater (not shown). At the ends of the electron interaction region 20 the active cathode 12 terminates in metallic end hats 22 as of molybdenum which serve to keep the electron stream 24 confined in interaction region 20 encircling cathode 12. In this embodiment, uniformly spaced from cathode 12 is the active surface 28 of the interdigital delay line 30. The line, as of copper, consists of annular discs 32 projecting inward from vacuum envelope 14. Each disc 32 supports a periodic set of fingers 34, 35. The two sets of fingers 34, 35 interleave to form a meandering open slot 36 between them. The *rf* wave basically follows this slot similar to the wave on a two wire transmission line, at a velocity approximating the speed of light. Thus the progress of the wave along the extent of the circuit is reduced below the velocity of light by approximately the ratio of the total length of the slot per unit period to the spatial pitch. The inner faces 28 of fingers 34, 35 lie on a cylinder coaxial with the cathode. The finger 38, 39 at each end of the line is directly connected to the center conductor 40 of a coaxial transmission line 42, 43 which lends out through vacuum envelope 14 via a wave-permeable window seal 44, as of alumina ceramic. In the tube of FIGS. 1, 2, 3 input wave energy is fed in via coaxial line 42 which is directly coupled to first finger 38 of delay line 30. The energy propagates, clockwise in FIG. 1, along delay line 30 to output coaxial line 43 which is coupled to last finger 39 of line 30, the circuit wave being amplified meanwhile by interaction with electron stream 24.

The region between input and output fingers 38, 39 is occupied by a non-propagating anode drift section 44 having an inner surface 46 on the same cylinder as active surface 28 of line 30. Anode drift section 44 prevents *rf* circuit energy from propagating from output 39 around to input 38. Also, as the electron stream passes surface 46, free from *rf* fields, the spokes are dispersed so as to attenuate any *rf* signal energy carried by the electrons. In operation, a negative potential is applied to cathode support 18 with respect to envelope 14 and circuit 30. An axial magnetic field is applied between polepieces 48, 49 by a magnet (not shown).

The periodic pitch or spatial period $p$ of slow-wave circuit 30 is tapered over a greater part of its length from a larger value $p_1$, at the input to a smaller value $p_2$ at the output. To do this the width of fingers 34, 35 is reduced, keeping the width of the slot 36 between them constant. In this way wave reflections along line 30 or at its couplings to transmission lines 42, 43 may be avoided. In FIGS. 1, 2 the amount of tapering has been greatly exaggerated and the number of line elements greatly minimized from those used in practice, to more clearly illustrate the invention.

Figure 4:
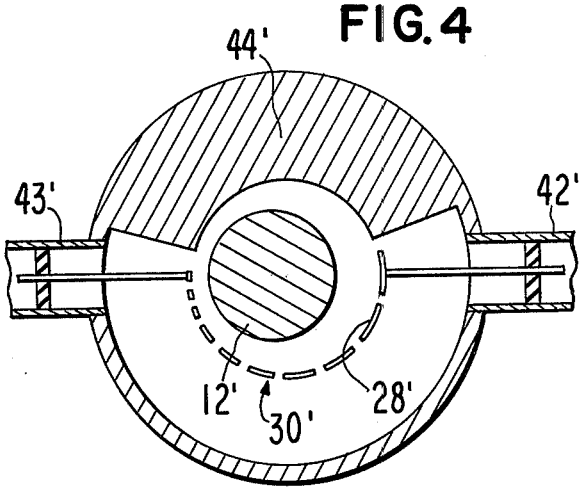
FIG. 4 is a section of an embodiment comprising an offcenter cylindrical cathode.

FIG. 4 illustrates schematically an embodiment of the invention wherein cylindrical cathode 12' is displaced from the center of interaction surface 28' toward the output 43'. As described above, this tapers upward the dc electric field, hence the overvoltage factor $g$.

Figure 5:
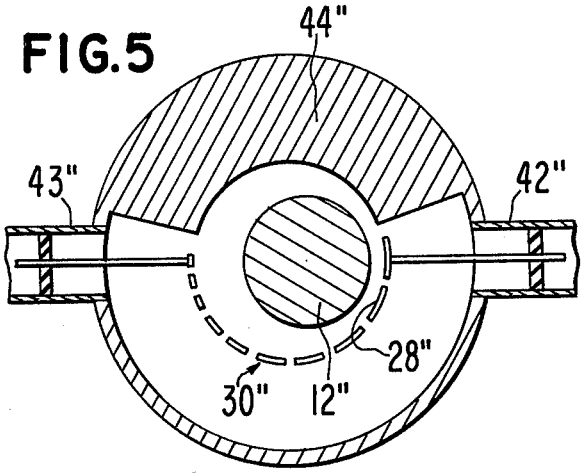
FIG. 5 is a section of another embodiment in which the cathode is displaced toward the input.

The embodiment shown in FIG. 5 illustrates the unexpected, novel result that the pitch taper of the present invention can be made great enough so the cathode 12'' can actually be displaced from the tube axis toward input 42'' to produce maximum spoke stability in the input region while the pitch taper overrides the *dc* field effect to still taper upward the overvoltage *g*.

Figure 6:
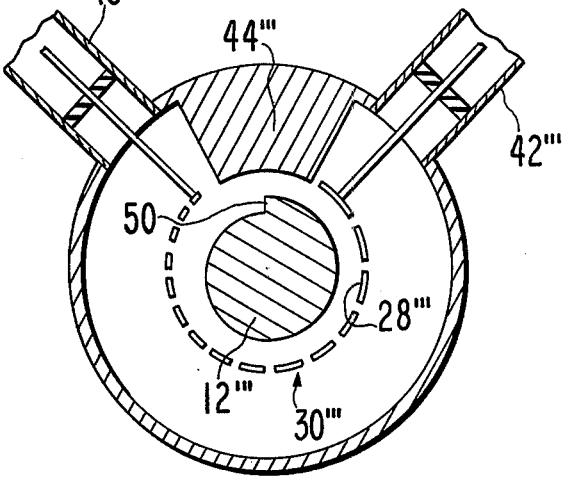
FIG. 6 is a section of an embodiment comprising a spiral-section cathode.

Displacing the circular cylinder cathode 12 of FIGS. 4, 5 is clearly effective only if the active circuit 30 extends over not more than 180° of the cylindrical anode surface. FIG. 6 illustrates an embodiment in which the interaction length may be as large as desired. The spiral cross-section of the cathode 12''' may be designed to produce any desired taper of cathode-anode spacing. The abrupt step return 50 to the greater spacing, located opposite drift section 44, is actually advantageous in scrambling the left-over electron spokes.

Figure 7:
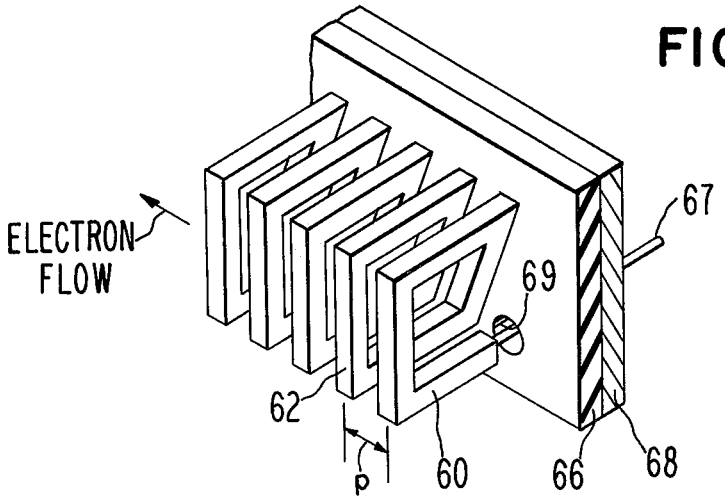
FIG. 7 is a perspective view of a portion of a helix slow-wave circuit useful for the invention.

FIG. 7 is a perspective view of a portion of a helix-type slow-wave circuit useful in embodiments of the invention. A single rectangular metallic conductor 60 as of copper is formed in the shape of a helix of rectangular cross section. The set of corresponding faces 62 of each turn forms the interaction surface facing the electrons. These faces 62 are elongated perpendicular to the electron drift direction. Opposite face 64 of each turn is joined as by brazing to an insulating sheet 66 as of beryllia ceramic, which supports helix 60 and conducts heat from it. Insulator 66 is in turn joined to a metal wall 68 which is preferably part of the vacuum envelope 14. The free ends of helix 60 are joined to central conductors 67 of a coaxial transmission line, passing out through openings 69 in the wall 66, 68.

Figure 8:
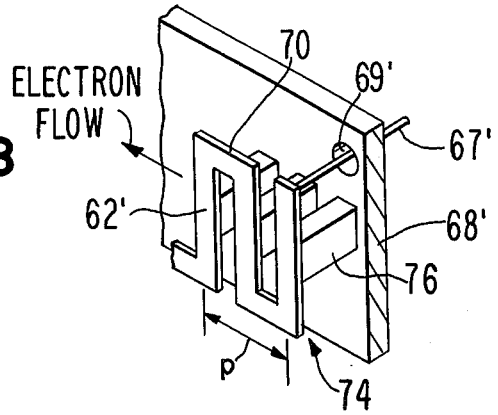
FIG. 8 is a perspective view of a portion of a meanderline circuit useful for the invention.

FIG. 8 illustrates a section of yet another suitable circuit. Here a single conductor 70 is shaped as a meanderline with one face 62' opposing the electron stream. The opposite face 74 of each element is supported from the envelope wall 68' by a metallic stub 76 which is preferably one quarter wavelength long at the operating frequency in order to present the least perturbation to the wave on the meandering conductor.

Figure 9:
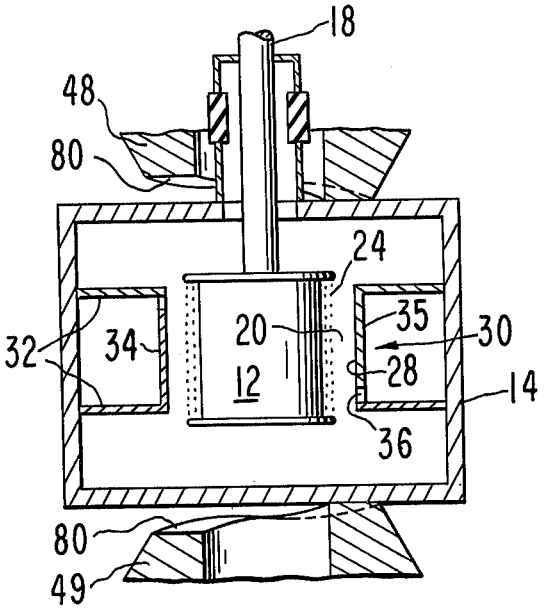
FIG. 9 is a section similar to FIG. 2 but showing an embodiment comprising a tapered magnetic field.

FIG. 9 illustrates an embodiment in which the electron drift velocity is tapered by tapering the magnetic field. The construction is similar to that of FIGS. 1, 2, 3 except that adjacent the output end 39 of circuit 30 the inner faces 80 of polepieces 48, 49 are tapered farther apart to reduce the magnetic field and increase the drift velocity.

It will be readily apparent to those skilled in the art that many other forms of slow-wave circuits may be used in connection with the invention, such as vane circuits, coupled cavities etc., but preferably circuits with small dispersion such as helix-coupled bars, multiple and cross-wound helices, etc. Also, other means and degrees of tapering the circuit pitch will be apparent. Furthermore, the invention may be used in non-reentrant-beam amplifiers including linear cross-field tubes. The above examples are merely for illustrative purposes. The invention is intended to be defined only by the following claims and their legal equivalents.

I claim:

1. A crossed-field amplifier comprising:

a periodic slow-wave circuit extending over a path between an input end and an output end, cathode means spaced from said circuit and extending over the length of said path, said cathode means applied to operate at a potential negative to said circuit and to generate a stream of electrons between said cathode and said circuit, means for coupling electromagnetic wave energy into said input end, means for coupling electromagnetic wave energy from said output end, the spatial period of said circuit decreasing over a substantial portion of said path from said input end to said output end;

and means for tapering the electron drift velocity along said path.

2. The amplifier of claim 1 wherein said means for tapering said velocity comprises means for tapering the transverse magnetic field along said stream of electrons.

3. The amplifier of claim 1 wherein said means for tapering said velocity comprises means for tapering the transverse electric field along said stream.

4. The amplifier of claim 3 wherein said means for tapering said electric field comprises tapering the spacing between said cathode and said circuit.

5. The amplifier of claim 4 wherein the surface of said slow-wave circuit facing said cathode lies substantially on a first right circular cylinder, and wherein said cathode has a right-cylindrical surface facing said circuit, and wherein the axis of said cathode surface is parallel to and displaced from the axis of said first cylinder.

6. The amplifier of claim 4 wherein said cylindrical cathode surface comprises a spiral cross section.

* * * * *